US010026251B2

(12) United States Patent
Sakamoto

(10) Patent No.: US 10,026,251 B2
(45) Date of Patent: Jul. 17, 2018

(54) MONEY HANDLING APPARATUS AND MONEY HANDLING METHOD

(71) Applicant: GLORY LTD., Himeji-shi, Hyogo (JP)

(72) Inventor: Masao Sakamoto, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/454,343

(22) Filed: Mar. 9, 2017

(65) Prior Publication Data

US 2017/0270737 A1 Sep. 21, 2017

(30) Foreign Application Priority Data

Mar. 18, 2016 (JP) ..... 2016-055492

(51) Int. Cl.

| | |
|---|---|
| ***G07F 7/04*** | (2006.01) |
| ***G07D 11/00*** | (2006.01) |
| ***G07D 7/00*** | (2016.01) |

(52) U.S. Cl.

CPC ..... *G07D 11/0051* (2013.01); *G07D 7/00* (2013.01); *G07D 11/0054* (2013.01); *G07D 11/0084* (2013.01); *G07F 7/04* (2013.01)

(58) Field of Classification Search

CPC .. G07D 7/00; G07D 11/0045; G07D 11/0051; G07D 11/0054; G07F 7/00; G07F 7/04; G07F 19/202

See application file for complete search history.

(56) References Cited

U.S. PATENT DOCUMENTS 4,905,840 A * 3/1990 Yuge ..... G07D 11/0072 209/534
4,968,015 A * 11/1990 Calverley ..... B65H 3/063 271/187
5,799,288 A * 8/1998 Tanaka ..... G06Q 20/108 705/42
6,493,461 B1 * 12/2002 Mennie ..... G07D 7/162 382/135
6,929,109 B1 8/2005 Klein et al.
(Continued)

FOREIGN PATENT DOCUMENTS

EP 0 753 524 A2 1/1997
EP 2 234 074 A1 9/2010

OTHER PUBLICATIONS

European Search Report (Application No. 17158055.8) (7 pages—dated Aug. 21, 2017).

*Primary Examiner* — Mark J Beauchaine
(74) *Attorney, Agent, or Firm* — Renner, Kenner, Greive, Bobak, Taylor & Weber

(57) ABSTRACT

Burden on users is reduced. A setting unit is configured to set information about the use environment concerning a use environment in which a money handling apparatus is used. A transport unit is configured to transport money. A recognition unit is configured to recognize a kind of the money. A control unit is configured to control transporting of the money by the transport unit, according to a recognition result for the money by the recognition unit. Further, the control unit controls transporting of the money according to the information about the use environment that is set by the setting unit, in a case where a kind, of the money, recognized by the recognition unit corresponds to a predetermined specific kind.

13 Claims, 10 Drawing Sheets

| USE ENVIRONMENT INFORMATION | | SPECIFIC MONEY TRANSPORT CONTROL METHOD |
|---|---|---|
| SHOP ITEM (BUSINESS TYPE) | USE PLACE ITEM (BACK OFFICE/FRONT) | REJECTED NOTE IN DISPENSING |
| BANK | BACK OFFICE | TRANSPORTED TO HANDLING UNIT |
| BANK | FRONT | TRANSPORTED TO HANDLING UNIT |
| OTHER THAN BANK | BACK OFFICE | TRANSPORTED TO HANDLING UNIT |
| OTHER THAN BANK | FRONT | TRANSPORTED TO SAFE UNIT |

(56) References Cited

U.S. PATENT DOCUMENTS

| | | | | |
|---|---|---|---|---|
| 2010/0168902 | A1* | 7/2010 | Mizushima ..... | G07D 11/0045 700/214 |
| 2013/0060375 | A1* | 3/2013 | Sato ..... | G07D 11/0084 700/218 |
| 2014/0238815 | A1 | 8/2014 | Iwamura et al. | |

* cited by examiner

FIG. 4

| USE ENVIRONMENT INFORMATION | | | SPECIFIC MONEY TRANSPORT CONTROL METHOD |
|---|---|---|---|
| USE PLACE ITEM (COUNTRY OR REGION) | SHOP ITEM (BUSINESS TYPE) | USE SUBJECT PERSON ITEM (STAFF/CUSTOMER) | COUNTERFEIT NOTE |
| EUROPE | BANK | STAFF | RETURN |
| EUROPE | BANK | CUSTOMER | COLLECTION |
| EUROPE | OTHER THAN BANK | STAFF | COLLECTION |
| EUROPE | OTHER THAN BANK | CUSTOMER | COLLECTION |
| OTHER THAN EUROPE | BANK | STAFF | RETURN |
| OTHER THAN EUROPE | BANK | CUSTOMER | RETURN |
| OTHER THAN EUROPE | OTHER THAN BANK | STAFF | RETURN |
| OTHER THAN EUROPE | OTHER THAN BANK | CUSTOMER | RETURN |

FIG. 6

| USE ENVIRONMENT INFORMATION | | SPECIFIC MONEY TRANSPORT CONTROL METHOD |
|---|---|---|
| USE PLACE ITEM (COUNTRY OR REGION) | SHOP ITEM (BUSINESS TYPE) | UNFIT NOTE |
| DEVELOPING COUNTRY | CENTRAL BANK | HANDLED AS UNFIT NOTE |
| DEVELOPING COUNTRY | OTHER THAN CENTRAL BANK | HANDLED AS FIT NOTE |
| OTHER THAN DEVELOPING COUNTRY | CENTRAL BANK | HANDLED AS UNFIT NOTE |
| OTHER THAN DEVELOPING COUNTRY | OTHER THAN CENTRAL BANK | HANDLED AS UNFIT NOTE |

FIG. 7

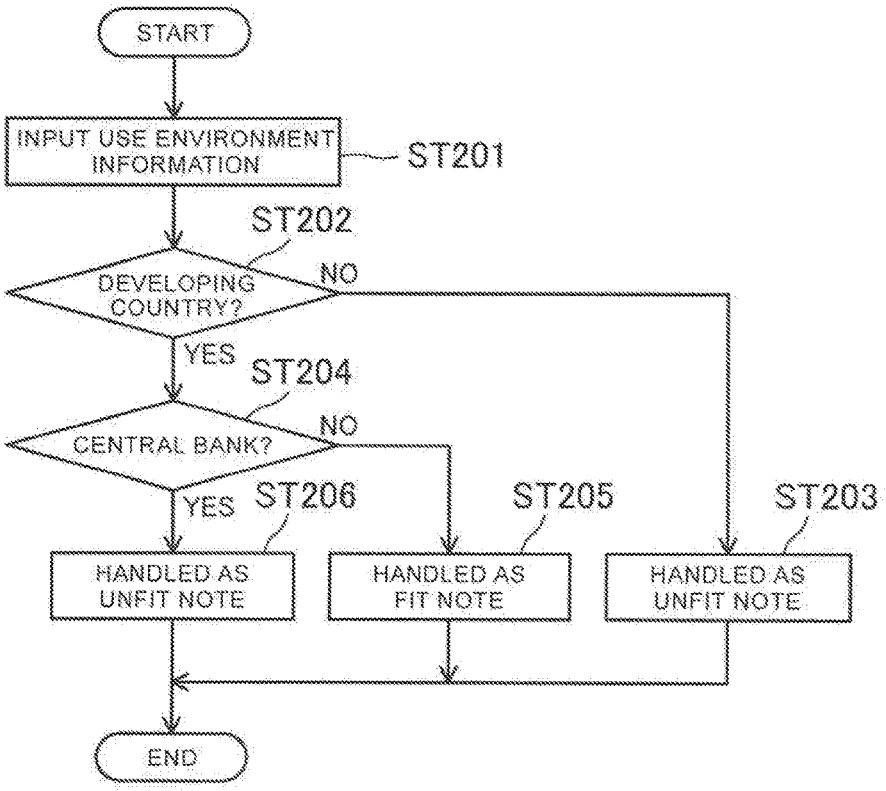

| USE ENVIRONMENT INFORMATION | | SPECIFIC MONEY TRANSPORT CONTROL METHOD |
|---|---|---|
| SHOP ITEM (BUSINESS TYPE) | USE PLACE ITEM (BACK OFFICE/FRONT) | REJECTED NOTE IN DISPENSING |
| BANK | BACK OFFICE | TRANSPORTED TO HANDLING UNIT |
| BANK | FRONT | TRANSPORTED TO HANDLING UNIT |
| OTHER THAN BANK | BACK OFFICE | TRANSPORTED TO HANDLING UNIT |
| OTHER THAN BANK | FRONT | TRANSPORTED TO SAFE UNIT |

FIG. 11

| USE ENVIRONMENT INFORMATION | | | SPECIFIC STATE TRANSPORT CONTROL METHOD | | |
|---|---|---|---|---|---|
| USE PLACE ITEM | SHOP ITEM | USE SUBJECT PERSON ITEM | OVERFLOW STATE | DENOMINATION-UNSET STATE | STORAGE-CASSETTE-UNMOUNTED STATE |
| ... | ... | ... | ... | ... | ... |
| ... | ... | ... | ... | ... | ... |
| ... | ... | ... | ... | ... | ... |
| ... | ... | ... | ... | ... | ... |

| USE ENVIRONMENT INFORMATION | SPECIFIC MONEY TRANSPORT CONTROL METHOD |
|---|---|
| USE SUBJECT PERSON ITEM (USER LEVEL) | COUNTERFEIT NOTE |
| GREATER THAN OR EQUAL TO REFERENCE LEVEL | RETURN |
| LESS THAN REFERENCE LEVEL | COLLECTION |

MONEY HANDLING APPARATUS AND MONEY HANDLING METHOD

CROSS REFERENCE TO RELATED APPLICATION

The disclosure of Japanese Patent Application No. 2016-055492, filed on Mar. 18, 2016, is incorporated herein by reference.

BACKGROUND OF THE INVENTION

Field of the Invention

The techniques disclosed herein relate to money handling techniques for handling money.

Description of the Background Art

To date, in financial facilities or the like in which money is handled, money handling apparatuses have been used. This type of money handling apparatus is disclosed in, for example, U.S. Pat. No. 6,929,109 (hereinafter, referred to as Patent Literature 1). A money handling system that operates in some modes according to an operation instruction from a user, is disclosed in Patent Literature 1.

SUMMARY OF THE INVENTION

However, in the money handling system disclosed in Patent Literature 1, although setting for control of transporting various kinds of money is performed for each mode according to an operation instruction from a user, the control of transport in the money handling apparatus is increasingly complicated in recent years. Thus, it is difficult for a user her/himself to correctly perform setting as described in Patent Literature 1, and the user is burdened therewith.

An object of the techniques disclosed herein is to provide a money handling apparatus and a money handling method that allows reduction of burden on a user.

The techniques disclosed herein are directed to a money handling apparatus that handles money. The money handling apparatus includes: a setting unit configured to set information about the use environment concerning a use environment in which the money handling apparatus is used; a transport unit configured to transport the money; a recognition unit configured to recognize a kind of the money; and a control unit configured to control transporting of the money by the transport unit, according to a recognition result for the money by the recognition unit. The control unit controls transporting of the money according to the information about the use environment that is set by the setting unit, in a case wherein a kind, of the money, recognized by the recognition unit corresponds to a predetermined specific kind.

In the above configuration, the setting unit sets the information about the use environment concerning a user environment in which the money handling apparatus is used, whereby the control unit can perform control (control for transporting of the money by the transport unit) according to the information about the use environment. Thus, transporting of the money can be automatically controlled according to the use environment of the money handling apparatus, whereby burden on users can be reduced.

The information about the use environment may include information about at least one of: a place in which the money handling apparatus is used; a shop in which the money handling apparatus is installed; and a user who uses the money handling apparatus.

In the above configuration, transporting of the money can be automatically controlled according to at least one of a place in which the money handling apparatus is used, a shop in which the money handling apparatus in installed, and a user who uses the money handling apparatus.

The place information may represent a country or a region that includes a place in which the money handling apparatus is installed, or a position, in a facility, at which the money handling apparatus is installed.

In the above configuration, transporting of the money can be automatically controlled according to a country or a region that includes a place in which the money handling apparatus is installed, or a position, in a facility, at which the money handling apparatus is installed.

The shop information may represent a business type of a shop in which the money handling apparatus is installed.

In the above configuration, transporting of the money can be automatically controlled according to a business type of a shop in which the money handling apparatus is installed.

The user information may represent the role of a user who uses the money handling apparatus.

In the above configuration, transporting of the money can be automatically controlled according to the role of a user who uses the money handling apparatus.

The control unit may stop transporting the money according to the information about the use environment which is set by the setting unit, in a case where a kind, of the money, recognized by the recognition unit corresponds to the specific kind.

In the above configuration, transporting of the money can be stopped according to the use environment of the money handling apparatus.

The control unit may transport the money to a predetermined destination according to the information about the use environment which is set by the setting unit, in a case where a kind, of the money, recognized by the recognition unit corresponds to the specific kind.

In the above configuration, the money can be transported to a predetermined destination according to the use environment of the money handling apparatus.

The destination may include a return unit for returning the money to an outside of the money handling apparatus, and a reception unit for taking the money into the money handling apparatus. The specific kind of money may correspond to counterfeit money. The control unit may determine, in a case where a kind, of the money, recognized by the recognition unit corresponds to the counterfeit money, whether the money is transported to the return unit or the reception unit, according to the information about the use environment.

In the above configuration, transporting of counterfeit money can be automatically controlled according to the use environment of the money handling apparatus.

The specific kind of money may correspond to unfit money, and the control unit may determine, in a case where a kind, of the money, recognized by the recognition unit corresponds to the unfit money, whether the money is handled as unfit money or fit money, according to the information about the use environment.

In the above configuration, transporting of unfit money can be automatically controlled according to the use environment of the money handling apparatus.

The destination may include a first storage unit, and a second storage unit having a security level higher than a security level of the first storage unit. The specific kind of money may correspond to rejected money in dispensing. The control unit may determine, in a case where the money recognized by the recognition unit corresponds to the rejected money in dispensing, whether the money is transported to the first storage unit or the second storage unit, according to the information about the use environment.

In the above configuration, transporting of rejected money in dispensing can be automatically controlled according to the use environment of the money handling apparatus.

The money handling apparatus may further include a state detection unit configured to detect a use state in which the money handling apparatus is used, and the control unit may control transporting of the money according to the use state and the information about the use environment.

In the above configuration, transporting of the money can be automatically controlled according to the use environment of the money apparatus and the use state of the money handling apparatus.

The money handling apparatus may further include a storage unit configured to store the money, and the control unit may control, in a case where the state detection unit detects that the storage unit is full, transporting of a kind of the money to be transported to the storage unit which is full, according to the information about the use environment.

In the above configuration, in a case where the storage unit is full, transporting of a kind of money to be transported to the storage unit which is full, can be automatically controlled according to the use environment of the money handling apparatus.

The money handling apparatus may further include a storage unit configured to store the money. The control unit may control, in a case where the state detection unit detects that a kind of the money recognized by the recognition unit is not assigned to the storage unit, transporting of the kind of the money, according to the information about the use environment.

In the above configuration, in a case where a kind of the money recognized by the recognition unit is not assigned to the storage unit, transporting of the kind of the money can be automatically controlled according to the use environment of the money handling apparatus.

The money handling apparatus may further include a storage unit detachably mounted to the money handling apparatus and configured to store the money. The control unit may control, in a case where the state detection unit detects that the storage unit is detached from the money handling apparatus, transporting of the money to be transported to the storage unit which is detached, according to the information about the use environment.

In the above configuration, in a case where the storage unit is detached from the money handling apparatus, transporting of money to be transported to the storage unit which is detached, can be automatically controlled according to the use environment of the money handling apparatus.

The money handling apparatus may further include an operator determination unit configured to determine whether or not an operator of the money handling apparatus is a predetermined operator. The settling unit may allow, in a case where the operator determination unit determines that the operator is the specific operator, the information about the use environment to be set according to an operation performed by the operator.

In the above configuration, an operator corresponding to the predetermined operator can be allowed to perform selling of the information about the use environment.

The techniques disclosed herein are directed to a money handling method in which a money handling apparatus handles money. The money handling method includes: a setting step of setting information about the use environment concerning a use environment in which the money handling apparatus is used; a recognition step of recognizing a kind of the money; and a transport control step of controlling transporting of money corresponding to a predetermined specific kind among kinds of the money, according to the information about the use environment which is set in the setting step.

In the above method, the information about the use environment concerning the use environment in which the money handling apparatus is used, is set in the setting step, whereby control (control for transporting of the money by the transport unit) according to the information about the use environment can be performed in the transport control step. Thus, transporting of the money can be automatically controlled according to the use environment of the money handling apparatus, whereby the burden on users can be reduced.

As described above, transporting of money can be automatically controlled according to the use environment, whereby burden on users can be reduced.

BRIEF DESCRIPTION OF THE DRAWINGS

FIG. 4 illustrates a transport control table, according specific example 1, which indicates correspondence between information about the use environment and specific money transport control methods;

FIG. 6 illustrates a transport control table, according to specific example 2, which indicates correspondence between information about the use environment and specific money transport control methods;

FIG. 7 is a flow chart showing an operation, according to specific example 2, performed by the banknote handling apparatus;

FIG. 11 illustrates a specific example of a transport control table that indicates correspondence between information about the use environment and specific state transport control methods;

DESCRIPTION OF THE PREFERRED EMBODIMENTS

Figure 1:
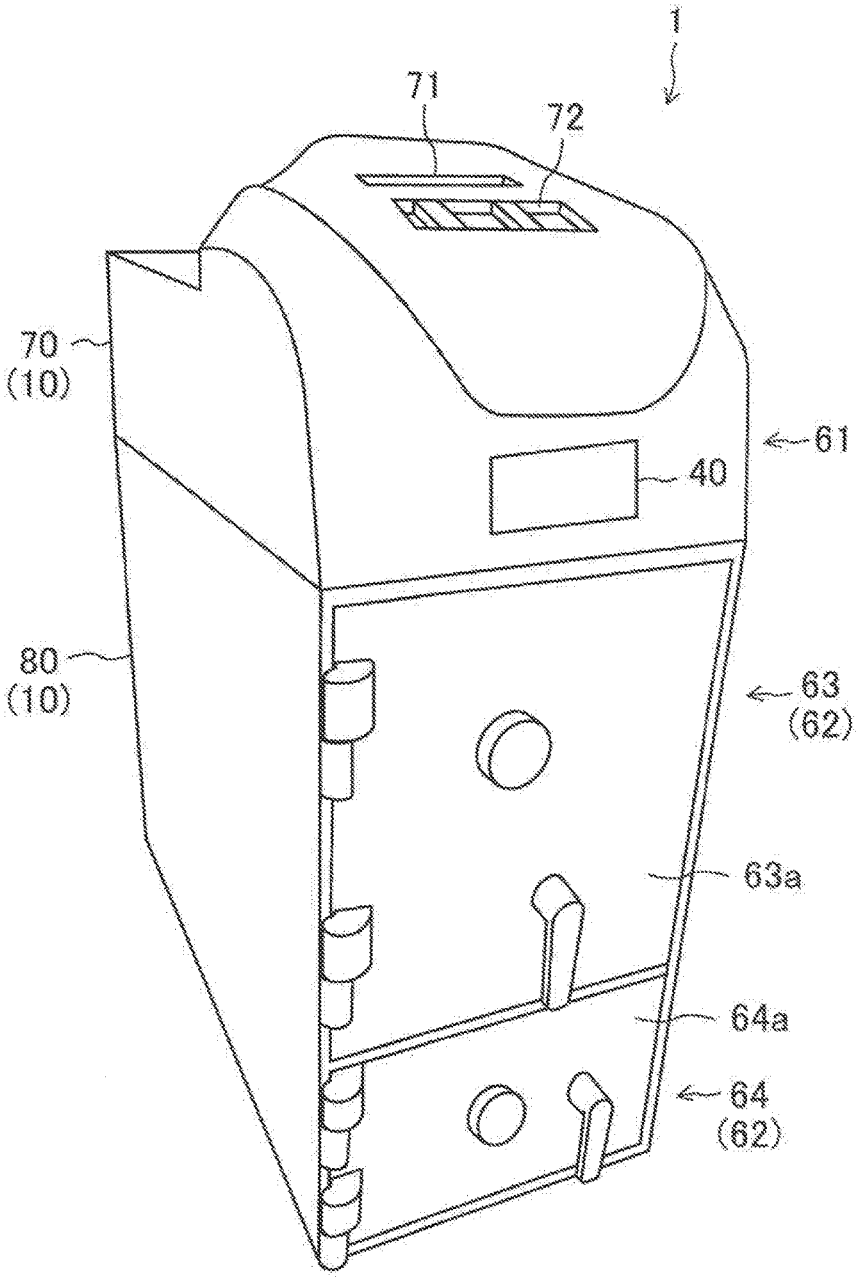
FIG. 1 is a schematic perspective view of a banknote handling apparatus according to an embodiment.

Embodiments will be described below in detail with reference to the drawings. In the drawings, the same or corresponding parts are denoted by the same reference numerals, and description thereof is not repeated.

(Banknote Handling Apparatus)

Figure 2:
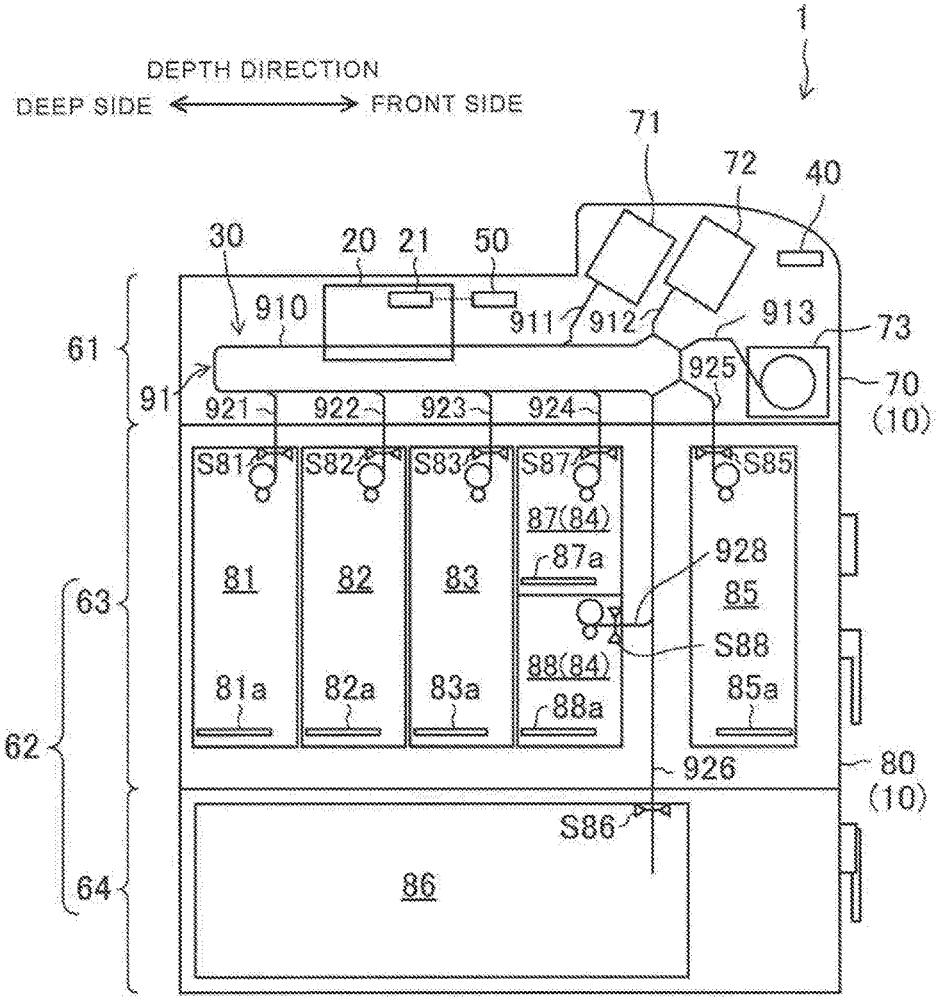
FIG. 2 schematically illustrates a structure of the banknote handling apparatus according to the embodiment.

FIG. 1, FIG. 2 illustrate an example of a structure of a banknote handling apparatus 1 according to an embodiment. The banknote handling apparatus 1 represents an example of a money handling apparatus that handles money. In this example, the banknote handling apparatus 1 is structured as a circulation-type depositing and dispensing machine, and banknotes dispensed by the banknote handling apparatus 1 in a dispensing step include banknotes that have been stored in the banknote handling apparatus 1 in a depositing step. Specifically, the banknote handling apparatus 1 includes a housing 10, a recognition unit 20, a transport unit 30, an operation unit 40, and a control unit 50. The banknote handling apparatus 1 is divided mainly into a handling unit 61 and a safe unit 62. The safe unit 62 is divided into a first safe unit 63 and a second safe unit 64.

[Housing]

In the housing 10, the recognition unit 20, the transport unit 30 and the control unit 50 are housed. Further, the operation unit 40 is disposed on the front surface of the housing 10. The housing 10 includes a handling unit housing 70 that includes the handling unit 61, and a protective housing 80 that includes the safe unit 62.

[Handling Unit Housing]

In the handling unit housing 70, the recognition unit 20, the transport unit 30, the operation unit 40, and the control unit 50 are disposed. In this example, the handling unit 61 comprises the handling unit housing 70, the recognition unit 20, the transport unit 30, the operation unit 40 and the control unit 50. Further, in the handling unit housing 70, a depositing unit 71, a dispensing unit 72 and an escrow unit 73 are disposed.

<Depositing Unit>

The depositing unit 71 is configured to allow banknotes to be inserted thereinto. In this example, the depositing unit 71 has an inlet disposed in the upper surface of the handling unit housing 70 so as to be opened upward, and is configured to receive a plurality of banknotes at one time. Further, the depositing unit 71 has a feeding mechanism (not shown). The feeding mechanism is configured to feed a plurality of banknotes inserted into the depositing unit 71, one by one, into the transport unit 30. Further, the depositing unit 71 may include various kinds of sensors (not shown) such as a banknote sensor which detects whether or not a banknote is in the depositing unit 71. Specifically, the banknote sensor is configured to have a transmitter unit that transmits light and a receiver unit that receives light, and to detect that a banknote is present when light that is emitted from the transmitter unit and is prevented from reaching the receiver unit. The banknote sensor is disposed such that it detects a banknote in the depositing unit 71 when light is blocked by a banknote in the depositing unit 71.

<Dispensing Unit>

The dispensing unit 72 is configured to dispense banknotes. In this example, the dispensing unit 72 is configured to stack transported banknotes. Further, the dispensing unit 72 is configured to have an outlet that is open in the diagonally upward direction in a portion forward (in FIG. 2, rightward) of the inlet of the depositing unit 71 in the apparatus, and that extends from the upper surface onto the front surface of the handling unit housing 70, and which is able to hold a plurality of banknotes at one time. Further, the dispensing unit 72 may include various kinds of sensors (not shown) such as a banknote sensor which detects whether or not a banknote is in the dispensing unit 72.

<Escrow Unit>

The escrow unit 73 is configured to escrow banknotes. In this example, the escrow unit 73 is structured as a reel-type escrow unit. That is, the escrow unit 73 reels up banknotes one by one and stores the banknotes. It feeds the banknotes one by one in an order reverse to an order in which the banknotes were stored (in a so-called first-in last-out method). Further, the escrow unit 73 may include various kinds of sensors (not shown) such as a banknote sensor which detects whether or not a banknote is in the escrow unit 73.

[Protective Housing]

The protective housing 80 is configured to perform protection at a minimum security level or higher level. Specifically, the security level of the protective housing 80 is higher than the security level of the handling unit housing 70. On the front surface of the protective housing 80, a first openable/closable door 63*a* for opening and closing the first safe unit 63, and a second openable/closable door 64*a* for opening and closing the second safe unit 64 are individually provided. The first and the second openable/closable doors 63*a* and 64*a* individually include electronic locks. In such a configuration, an access right to the first safe unit 63 and an access right to the second safe unit 64 are different.

In the upper portion of the protective housing 80, a plurality of stacking-type storage cassettes (in this example, a first to a fifth storage cassettes 81 to 85) are housed. In the lower portion of the protective housing 80, a stacking-type collection cassette 86 is housed. In this example, the first safe unit 63 is structured by the upper portion of the protective housing 80 and the first to the fifth storage cassettes 81 to 85, and the second safe unit 64 is structured by the lower portion of the protective housing 80 and the collection cassette 86.

<Storage Cassette>

The first to the fifth storage cassettes 81 to 85 are detachably mounted in the first safe unit 63. Specifically, the first safe unit 63 includes a sliding portion (not shown) that can be drawn from the front side of the apparatus in a state in which the first safe door 63*a* of the first safe unit 63 is opened. The first to the fifth storage cassettes 81 to 85 are detachably mounted to the slide portion.

The first, the second, the third, and the fifth storage cassettes 81, 82, 83, and 85 have shapes elongated in the up-down direction. On the upper surface of the first storage cassette 81, an inlet/outlet through which a banknote can pass is formed so as to connect between the outside of the cassette and the inside thereof. The second, the third, and the fifth storage cassettes 82, 83, and 85 have the same structure as the first storage cassette 81. Further, the first, the second, the third, and the fifth storage cassettes 81, 82, 83, 85 include tracking sensors S81, S82, S83, S85 and the stacking tables 81*a*, 82*a*, 83*a*, 85*a*, respectively. The tracking sensor S81 is configured to detect the passing of a banknote at the inlet/outlet of the first storage cassette 81. Specifically, the tracking sensor S81 includes a transmitter unit that transmits light and a receiver unit that receives light which is disposed such that light is blocked by a banknote that passes through the transport path 91 between the transmitter and receiver and detects that the banknote has passed when light is blocked. The tracking sensor S82, S83, S85 have the same structure as the tracking sensor S81. The stacking table 81*a* is structured so as to ascend and descent according to an amount of banknotes stacked in the first storage cassette 81. The stacking tables 82*a*, 83*a*, 85*a* have the same structure as the stacking table 81*a*.

The fourth storage cassette 84 has a partition thereinside, and is thus divided into a fourth storage cassette upper portion 87 on the upper side and a fourth storage cassette lower portion 88 on the lower side. On the upper surface of the fourth storage cassette upper portion 87, an inlet/outlet through which a banknote can pass is formed so as to connect between the outside of the cassette and the inside thereof. Further, the fourth storage cassette upper portion 87 includes a tracking sensor S87 and a stacking table 87*a*. The tracking sensor S87 and the stacking table 87*a* have the same structures as the tracking sensor S81 and the stacking table 81*a*, respectively. On the side surface of the fourth storage cassette lower portion 88, an inlet/out through which a banknote can pass is formed so as to connect between the outside of the cassette and the inside thereof. Further, the fourth storage cassette lower portion 88 includes a tracking sensor S88 and a stacking table 88*a*. The tracking sensor S88 and the stacking table 88*a* have the same structures as the tracking sensor S81 and the stacking table 81*a*, respectively.

In the above configuration, the first storage cassette 81 is structured so as to stack and store banknotes that are transported thereinto through the inlet/outlet from the transport unit 30, on the stacking table 81*a*, in order from the lower side toward the upper side, and so as to allow the banknotes stacked on the stacking table 81*a* to be fed out one by one in order from the upper side toward the lower side, through the inlet/outlet to the outside of the cassette (that is, into the transport unit 30). The second, the third, and the fifth storage cassettes 82, 83, 85, the fourth storage cassette upper portion 87, and the fourth storage cassette lower portion 88 have the same structure as the first storage cassette 81.

<Collection Cassette>

The collection cassette 86 is detachably mounted in the second safe unit 64. Further, the collection cassette 86 has a shape elongated in the apparatus depth direction, and has thereinside a banknote pressing member (not shown) that is movable in the depth direction. The collection cassette 86 is structured to store banknotes in a standing state so as to align the banknotes in the depth direction while the banknote pressing member moves according to an amount of stored banknotes. The collection cassette 86 is structured so as not to allow stored banknotes to be fed out. Further, the collection cassette 86 includes a tracking sensor S86. The tracking sensor S86 has the same structure as the tracking sensor S81. The collection cassette 86 may be structured so as not to be detached from the second safe unit 64.

[Recognition Unit]

The recognition unit 20 is structured so as to perform recognition of kinds of banknotes, and includes: various kinds of sensors such as a line sensor, a magnetic sensor, and an image sensor, and a recognition section 21. The recognition section 21 recognizes kinds of banknotes on the basis of characteristics, of the banknotes which are obtained by the various kinds of sensors. Specifically, the recognition section 21 compares characteristics of a banknote obtained by the various kinds of sensors, with previously stored characteristics of a banknote for each kind in order to recognize a kind of the banknote.

In this example, the recognition section 21 is configured to perform recognition of denominations and fitness/unfitness of banknotes, and perform authentication of the banknotes. In the recognition of denominations of banknotes, a currency unit of a banknote, a monetary value of the currency and the like are recognized. In the authentication of a banknote, the banknote is determined as a genuine note (genuine money) or a counterfeit note (counterfeit money). In the recognition of fitness/unfitness of a banknote, the banknote is determined as a fit note (fit money) or an unfit note (unfit money).

Further, in this example, the recognition section 21 is configured to recognize an abnormality in transporting a banknote. An abnormality in transporting a banknote represents an abnormal transporting state in which a banknote is not transported in a predetermined normal transporting state and the abnormality in transporting a banknote includes, for example, a skewed state (in which a skew angle of a banknote relative to the transporting direction is greater than a predetermined allowable skew angle) or chaining (in which a distance between continuously transported banknotes is less than a predetermined allowable distance-between-banknotes).

The recognition section 21 includes, for example, a calculation unit such as a CPU, or a memory (memory unit) which stores various programs and information for operating the calculation unit. Further, the recognition section 21 may be included in the control unit 50.

[Transport Unit]

The transport unit 30 is configured to transport banknotes. Specifically, the transport unit 30 has a transport path 91. The transport path 91 includes transport belts, a driving mechanism for driving the transport belts, and the like. In this example, the transport path 91 includes a loop transport path 910, an inlet path 911, a dispensing path 912, an escrow path 913, a first to a sixth diverging paths 921 to 926, and a diverging path 928. The inlet path 911 extends from the loop transport path 910 to the depositing unit 71. The dispensing path 912 extends from the loop transport path 910 to the dispensing unit 71. The escrow path 913 extends from the loop transport path 910 to the escrow unit 73. The first, the second, and the third diverging paths 921, 922, and 923 extend from the loop transport path 910 to the inlets/outlets of the first, the second, and the third storage cassettes 81, 82, and 83, respectively. The fourth diverging path 924 extends from the loop transport path 910 to the inlet/out of the fourth storage cassette upper portion 87. The fifth diverging path 925 extends from the loop transport path 910 to the inlet/outlet of the fifth storage cassette 85. The sixth diverging path 926 extends from the loop transport path 910 to the collection cassette 86. The diverging path 928 extends from the intermediate portion of the sixth diverging path 926 to the inlet/outlet of the fourth storage cassette lower portion 88. In the transport path 91, various kinds of sensors (not shown) such as tracking sensors for detecting passing of a banknote in the transport path 91, may be disposed.

[Operation Unit]

The operation unit 40 is operated by an operator, and allows input of information. In this example, the operation unit 40 doubles as a display unit for displaying information. Specifically, the operation unit 40 includes a touch panel. The operation unit 40 may have a function of reading an identification (ID) stored in an ID card.

[Control Unit]

Figure 3:
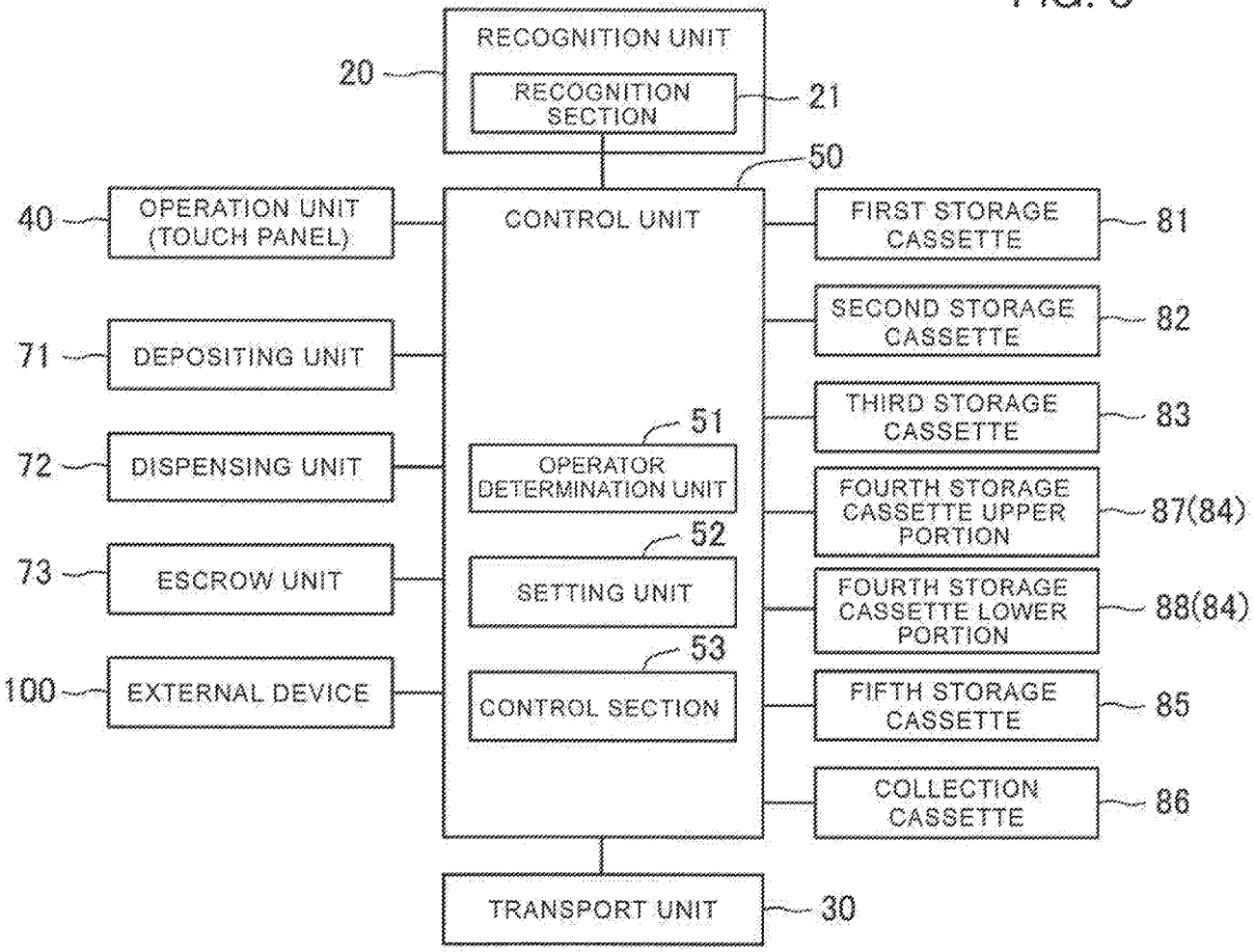
FIG. 3 is a block diagram illustrating the banknote handling apparatus according to the embodiment.

As shown in FIG. 3, the control unit 50 is connected to the depositing unit 71, the dispensing unit 72, the escrow unit 73, the first storage cassette 81, the second storage cassette 82, the third storage cassette 83, the fourth storage cassette 84 (fourth storage cassette upper portion 87 and fourth storage cassette lower portion 88), the fifth storage cassette 85, the collection cassette 86, the recognition section 21 of the recognition unit 20, the transport unit 30, and the operation unit 40 so as to be able to communicate therewith. The control unit 50 is connected to the various kinds of sensors (tracking sensors S81 to S83, S85 to S88, and the like) provided in the components of the banknote handling apparatus 1, and is configured to allow input of detection signals from the sensors. Further, the control unit 50 is connected to an external device 100 so as to be able to communicate therewith. Examples of the external device 100 include a higher-ranking terminal, such as a server, disposed in, for example, the center of a financial facility, a display device such as an external display, an output device such as a printer, a warning device such as a buzzer, an external storage device such as a USB memory, and an input device such as a card reader which reads an identification (ID) stored in an ID card. The control unit 50 may be connected therewith by either of wired connection or wireless connection. In this example, the control unit 50 includes an operator determination unit 51, a setting unit 52 and a control section 53.

<Operator Determination Unit>

The operator determination unit 51 is configured to determine whether or not an operator of the banknote handling apparatus 1 is a predetermined specific operator. In this example, the operator determination unit 51 is configured to determine whether or not an operator who operates the operation unit 40 is a predetermined specific operator. Specifically, the operator determination unit 51 compares an identification (ID) inputted to the operation unit 40 or an identification (ID), of an ID card, which is read by the operation unit 40, with a previously stored identification (ID) (identification (ID) assigned to the specific operator), and thus determine whether or not the operator is the specific operator.

<Setting Unit>

The setting unit 52 is configured to set information about the use environment. In this example, the setting unit 52 is configured to set (or change) the information about the use environment according to an operation performed on the operation unit 40 (that is, information inputted to the operation unit 40).

The information about the use environment represents information concerning a use environment in which the banknote handling apparatus 1 is used. Specifically, the information about the use environment includes at least one of place information, shop information, and user information. The place information represents information item concerning a place at which the banknote handling apparatus 1 is used, and represents, for example, a country or a region that includes the place at which the banknote handling apparatus 1 is installed, or a position, in a facility, at which the banknote handling apparatus 1 is installed. The shop information represents information item concerning a shop in which the banknote handling apparatus 1 is installed, and represents, for example, a business type of the shop in which the banknote handling apparatus 1 is installed. The user information represents information item concerning a user who uses the banknote handling apparatus 1, and represents, for example, the role of the user who uses the banknote handling apparatus 1.

In this example, when the operator determination unit 51 determines that an operator of the banknote handling apparatus 1 is the specific operator, the setting unit 52 allows setting of the information about the use environment to be performed according to an operation performed by the operator. When the operator determination unit 51 determines that an operator of the banknote handling apparatus 1 does not correspond to the specific operator, the setting unit 52 prohibits setting of the information about the use environment according to an operation performed by the operator. That is, only when the operator determination unit 51 determines that an operator is the specific operator, the setting unit 52 allows setting of the information about the use environment to be performed according to an operation performed by the operator.

Further, the setting unit 52 is configured to set a specific money transport rule. In this example, the setting unit 52 is configured to set (or change) the specific money transport rule according to an operation performed on the operation unit 40 (that is, information inputted to the operation unit 40). The specific money transport rule indicates that a transport control method (specific money transport control method) for a predetermined specific kind of banknotes is to be determined, from among transport control methods, according to the use environment of the banknote handling apparatus 1. Specifically, the setting unit 52 has a transport control table (see FIG. 4 or the like) indicating the specific money transport rule. The transport control table indicates correspondence between the information about the use environment and the transport control method (specific money transport control method) for a specific kind of banknotes.

In this example, when the operator determination unit 51 determines that an operator of the banknote handbag apparatus 1 is the specific operator, the setting unit 52 allows setting of the specific money transport rule to be performed according to an operation performed by the operator. When the operator determination unit 51 determines that an operator of the banknote handling apparatus 1 is not the specific operator, the setting unit 52 prohibits setting of the specific money transport rule according to an operation performed by the operator. That is, only when the operator determination unit 51 determines that an operator is the specific operator, the setting unit 52 allows setting of the specific money transport rule to be performed according to an operation performed by the operator.

<Control Section>

The control section 53 is configured to control transporting of a banknote by the transport unit 30 according to a recognition result for the banknote by the recognition section 21. Specifically, the control section 53 controls transporting of a banknote by the transport unit 30, on the basis of a predetermined sorting rule (rule indicating that a destination to which a banknote is transported is to be determined according to the kind of the banknote).

The control section 53 controls transporting of a banknote according to the information about the use environment which has been set by the setting unit 52 when a kind of the banknote recognized by the recognition section 21 corresponds to a predetermined specific kind.

For example, the control section 53 may be configured to stop transporting a banknote according to the information about the use environment which has been set by the setting unit 52 when a kind of the banknote recognized by the recognition section 21 corresponds to the specific kind. In this configuration, transporting of a banknote can be stopped according to the use environment of the banknote handling apparatus 1.

Alternatively, the control section 53 may be configured to transport a banknote to a predetermined transport destination according to the information about the use environment which has been set by the setting unit 52 when a kind of the banknote recognized by the recognition section 21 corresponds to the specific kind. In this configuration, a banknote can be transported to a predetermined transport destination according to the use environment of the banknote handling apparatus 1.

Specifically, the control section 53 determines the transport control method (specific money transport control method) for a specific kind of banknotes so as to correspond to the information about the use environment which has been set by the setting unit 52, on the basis of the specific money transport rule (see FIG. 4 and the like) which has been set by the setting unit 52, and controls transporting of banknotes (the specific kind of banknotes) by the transport unit 30, on the basis of the determined specific money transport control method, when the kind of the banknotes recognized by the recognition section 21 corresponds to the specific kind.

Further, the control section 53 is configured to count banknotes for each banknote kind. Further, the control section 53 is configured to generate an output date file in which information (result of counting of banknotes, recognition result for banknotes by the recognition section 21, and the like) of banknotes handled by the banknote handling apparatus 1 is registered for each banknote, and output the output data file to the external device 100.

[Operation Performed by Banknote Handling Apparatus]

Next an operation performed by the banknote handling apparatus 1 will be described. Firstly, the setting unit 52 performs setting of the information about the use environment concerning a use environment of the banknote handling apparatus 1. Next, the recognition section 21 recognizes a kind of a banknote. The control section 53 controls, according to the information about the use environment which has been set by the setting unit 52, transporting of banknotes corresponding to a predetermined kind among kinds of banknotes recognized by the recognition section 21.

[Effect by Embodiment]

As described above, the setting unit 52 sets the information about the use environment concerning the use environment of the banknote handling apparatus 1, whereby the control section 53 can perform control (control for transporting of banknotes by the transport unit 30) according to the information about the use environment. Thus, transporting of the banknotes can be automatically controlled according to the use environment of the banknote handling apparatus 1, and burden, on a user, which is required for performing setting for control of transporting according to the use environment of the banknote handling apparatus 1, can be reduced.

Further, the information about the use environment includes at least one of the place information (information item concerning a place in which the banknote handling apparatus 1 is used), the shop information (information item concerning a shop in which the banknote handling apparatus 1 is installed), and the user information (information item concerning a user who uses the banknote handling apparatus 1), whereby transporting of banknotes can be automatically controlled according to at least one of a place in which the banknote handling apparatus 1 is used, a shop in which the banknote handling apparatus 1 is installed, and a user who uses the banknote handling apparatus 1.

Specifically, when the place information of the information about the use environment represents a country or a region which includes a place in which the banknote handling apparatus 1 is installed, transporting of banknotes can be automatically controlled according to a country or a region which includes a place in which the banknote handling apparatus 1 is installed.

Further, when the place information of the information about the use environment represents a position, in a facility, at which the banknote handling apparatus 1 is installed, transporting of banknotes can be automatically controlled according to a position, in a facility, at which the banknote handling apparatus 1 is installed.

Further, when the shop information of the information about the use environment represents a business type of a shop in which the banknote handling apparatus 1 is installed, transporting of banknotes can be automatically controlled according to a business type of a shop in which the banknote handling apparatus 1 is installed.

Further, when the user information of the information about the use environment represents the role of a user of the banknote handling apparatus 1, transporting of banknotes can be automatically controlled according to the role of a user of the banknote handling apparatus 1.

Further, the setting unit 52 is configured to allow setting of the information about the use environment to be performed according to an operation performed by an operator when the operator determination unit 51 determines that the operator is the specific operator, whereby the operator corresponding to the specific operator is allowed to set the information about the use environment.

Further, the setting unit 52 is configured to prohibit setting of the information about the use environment according to an operation performed by an operator when the operator determination unit 51 determines that the operator does not correspond to the specific operator, whereby the operator who does not correspond to the specific operator can be prohibited from setting the information about the use environment.

[Handling of Counterfeit Notes in Europe]

Handling of counterfeit notes in Europe will be described. In Europe, counterfeit notes are required to be collected without returning the counterfeit notes to customers. Therefore, in a case where a place in which the banknote handling apparatus 1 is installed is in Europe, counterfeit notes are preferably taken into the banknote handling apparatus 1. Meanwhile, a place in which the banknote handling apparatus 1 is installed is in a country or a region other than Europe, a counterfeit note may be returned to the outside of the banknote handling apparatus 1. However, even when a place in which the banknote handling apparatus 1 is installed is in Europe, the business type of a shop in which the banknote handling apparatus 1 is installed is a bank, and a user of the banknote handling apparatus 1 is a staff member (a person who belongs to the bank), a counterfeit note is preferably returned to the outside of the banknote handling apparatus 1. This is because a staff member collects the counterfeit notes returned from the banknote handling apparatus 1, whereby an obligation of collecting counterfeit notes in Europe can be fulfilled.

[Specific Example 1 of Operation Performed by Banknote Handling Apparatus]

Next, specific example 1 of an operation performed by the banknote handling apparatus 1 will be described with reference to FIG. 4 and FIG. 5. In this example, the specific kind corresponds to a counterfeit note. Destinations to which a banknote is transported include a return unit (in this example, the dispensing unit 72) for returning the banknote to the outside of the banknote handling apparatus 1, and a reception unit (in this example, the collection cassette 86) for taking the banknote into the banknote handling apparatus 1. In a case where a kind of a banknote recognized by the recognition section 21 corresponds to a counterfeit note, the control section 53 determines whether the banknote is to be transported to the return unit or the reception unit, according to the information about the use environment which has been set by the setting unit 52.

Specifically, in this example, the information about the use environment includes the place information, the shop information, and the user information, and the place information represents a country or a region that includes a place in which the banknote handling apparatus 1 is installed, the shop information represents a business type of a shop in which the banknote handling apparatus 1 is installed, and the user information represents the role (staff member, customer, or the like) of the user of the banknote handling apparatus 1. Further, the setting unit 52 has a transport control table shown in FIG. 4. The transport control table (specific money transport rule) shown in FIG. 4 indicates whether the transport control method for a counterfeit note (specific kind of banknote), is to be a first transport control method in which the banknote is transported to the return unit, or a second transport control method in which the banknote is transported to the reception unit, is determined so as to correspond to the user environment of the banknote handling apparatus 1. The control section 53 determines one of the first transport control method or the second transport control method, as the transport control method (specific money transport control method), for the counterfeit note, corresponding to the information about the use environment which has been set by the setting unit 52, on the basis of the specific money transport rule which has been set by the setting unit 52, and, when a kind of a banknote recognized by the recognition section 21 corresponds to a counterfeit note, transporting of the banknote (counterfeit note) by the transport unit 30 is controlled on the basis of the determined specific money transport control method.

Figure 5:
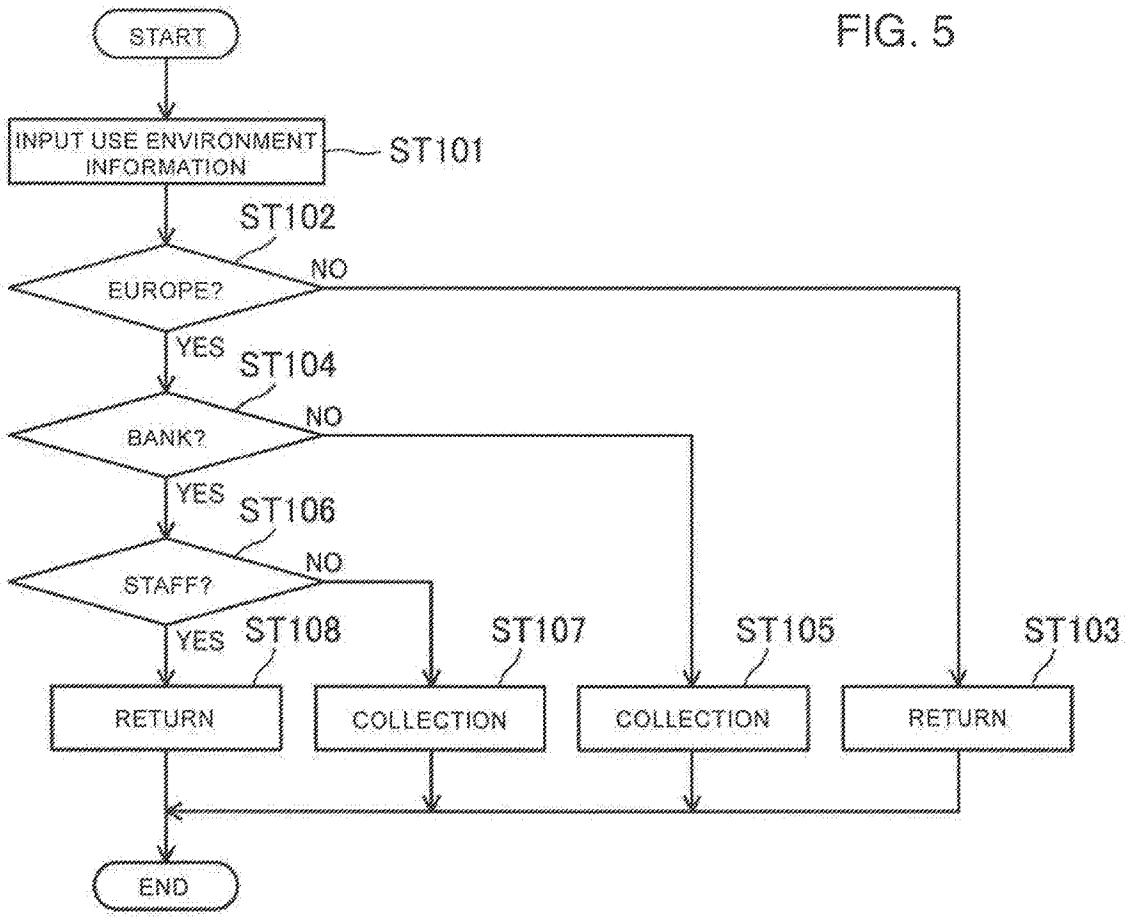
FIG. 5 is a flow chart showing an operation, according to specific example 1, performed by the banknote handling apparatus.

In this example, in the banknote handling apparatus 1, the setting operation shown in FIG. 5 is performed. The setting operation performed by the banknote handling apparatus 1 will be described with reference to FIG. 5.

<Step ST101>

First, the setting unit 52 sets the information about the use environment.

<Steps ST102, ST103>

Next, the control section 53 determines whether or not the country or the region indicated by the place information of the information about the use environment corresponds to Europe (ST102). When the country or the region indicated by the place information of the information about the use environment does not correspond to Europe, the control section 53 determines the first transport control method (transport control method in which a banknote is transported to the return unit) as the transport control method for a counterfeit note (ST103). Meanwhile, when the country or the region indicated by the place information of the information about the use environment corresponds to Europe, the process is advanced to step ST104.

<Steps ST104, ST105>

Next, the control section 53 determines whether or not the business type indicated by the shop information of the information about the use environment corresponds to a bank (ST104). When the business type indicated by the shop information of the information about the use environment does not correspond to a bank, the control section 53 determines the second transport control method (transport control method in which a banknote is transported to the reception unit) as the transport control method for a counterfeit note (ST105). Meanwhile, when the business type indicated by the shop information of the information about the use environment corresponds to a bank, the process is advanced to step ST106.

<Steps ST106, ST107, ST108>

Next, the control section 53 determines whether or not the role of the user indicated by the user information of the information about the use environment corresponds to a staff member (ST106). When the role of the user indicated by the user information of the information about the use environment does not correspond to a staff member, the control section 53 determines the second transport control method (transport control method in which a banknote is transported to the reception unit) as the transport control method for a counterfeit note (ST107). Meanwhile, when the role of the user indicated by the user information of the information about the use environment corresponds to a staff member, the control section 53 determines the first transport control method (transport control method in which a banknote is transported to the return unit) as the transport control method for a counterfeit note (ST108).

As described above, transporting of a counterfeit note can be automatically controlled according to the use environment of the banknote handling apparatus 1.

The above-described control is applicable not only when the specific banknote is a counterfeit note but also when the specific money is an unfit note. That is, the control section 53 may determine whether a banknote is to be transported to the return unit or the reception unit according to the information about the use environment which has been set by the setting unit 52, when a kind of the banknote recognized by the recognition section 21 is an unfit note.

[Handling of Unfit Notes in Developing Countries]

Handling of unfit notes in developing countries will be described. In developing countries, unfit note are to be preferably handled as fit notes in some cases. For example, in countries in which the monetary system is not fully developed and most of banknotes circulated in the market are unfit notes (that is, countries in which the proportion of unfit notes to banknotes circulated in the market is relatively high), when the unfit notes are handled as fit notes rather than as unfit notes, banknotes are more smoothly circulated in the market. However, in countries or regions other than the developing countries, unfit notes are preferably handled as unfit notes. Therefore, in a case where a place in which the banknote handling apparatus 1 is installed is in a developing country, the banknote handling apparatus 1 preferably handles unfit notes as fit notes, and a place in which the banknote handling apparatus 1 is installed is in a country or a region other than the developing countries, the banknote handling apparatus 1 preferably handles unfit notes as unfit notes. However, even in a case where a place in which the banknote handling apparatus 1 is installed is in a developing country, when a business type of a shop in which the banknote handling apparatus 1 is installed, is the central bank, the banknote handling apparatus 1 preferably handles unfit notes as unfit notes. This is because unfit notes are collected by the central bank also in a developing country in many cases.

<Specific Example 2 of Operation Performed by Banknote Handling Apparatus>

Next, specific example 2 of operation performed by the banknote handling apparatus 1 will be described with reference to FIG. 6 and FIG. 7. In this example, the specific kind corresponds to an unfit note. In a case where a kind of a banknote recognized by the recognition section 21 corresponds to an unfit note, the control section 53 determines whether the banknote is handled as an unfit note or a fit note, according to the information about the use environment which has been set by the setting unit 52.

Specifically, in this example, the information about the use environment includes the place information and the shop information, and the place information represents a country or a region that includes a place in which the banknote handling apparatus 1 is installed, and the shop information represents a business type of a shop in which the banknote handling apparatus 1 is installed. Further, the setting unit 52 has a transport control table shown in FIG. 6. The transport control table (specific money transport rule) shown in FIG. 6 indicates whether the transport control method for an unfit note (specific kind of banknote) is to be a first transport control method in which the banknote is handled as an unfit note or a second transport control method in which the banknote is handled as a fit note and is determined so as to correspond to the use environment of the banknote handling apparatus 1. The control section 53 determines one of the first transport control method or the second transport control method, as the transport control method (specific money transport control method), for the specific kind of banknote (unfit note), corresponding to the information about the use environment which has been set by the setting unit 52, on the basis of the specific money transport rule which has been set by the setting unit 52. In a case where a kind of a banknote recognized by the recognition section 21 corresponds to an unfit note, the control section 53 controls transporting of the banknote (unfit note) by the transport unit 30 on the basis of the determined specific money transport control method.

In this example, the banknote handling apparatus 1 performs the setting operation as shown in FIG. 7. The setting operation performed by the banknote handling apparatus 1 will be described with reference to FIG. 7.

<Step ST201>

The setting unit 52 sets the information about the use environment.

Steps <ST202, ST203>

Next, the control section 53 determines whether or not a country or the region indicated by the place information of the information about the use environment corresponds to a developing country (ST202). In a case where the country or the region indicated by the place information of the information about the use environment does not correspond to a developing country, the control section 53 determines the first transport control method (transport control method in which a banknote is handled as an unfit note) as the transport control method for an unfit note (ST203). Meanwhile, in a case where the country or the region indicated by the place information of the information about the use environment corresponds to a developing country, the process is advanced to step ST204.

Steps <ST204, ST205, ST206>

Next, the control section 53 determines whether or not the business type indicated by the shop information of the information about the use environment corresponds to a central bank (ST204). In a case where the business type indicated by the shop information of the information about the use environment does not correspond to a central bank, the control section 53 determines the second transport control method (transport control method in which a banknote is handled as a fit note) as the transport control method for an unfit note (ST205). Meanwhile, in a case where the business type indicated by the shop information of the information about the use environment corresponds to a central bank, the control section 53 determines the first transport control method (transport control method in which a banknote is handled as an unfit note) as the transport control method for an unfit note (ST206).

As described above, transporting of an unfit note can be automatically controlled according to the use environment of the banknote handling apparatus 1.

[Handling of Rejected Notes in Dispensing at Retail]

Handling of rejected notes in dispensing (rejected money in dispensing) at retail environment will be described. The retail represents a shop that belongs to a business type, such as retail business, other than banks. The rejected note in dispensing represents a banknote which is not appropriate to dispense. In general, the security level at retail is lower than the security level at banks. Therefore, in a case where a business type of a shop in which the banknote handling apparatus 1 is installed, is other than banks, rejected notes in dispensing are preferably stored in a storage unit having a relatively high security level in the banknote handling apparatus 1. In a case where a business type of a shop in which the banknote handling apparatus 1 is installed is a bank, notes rejected in dispensing may be stored in a storage unit having a relatively low security level in the banknote handling apparatus 1 since security is ensured in banks. However, even when a business type of a shop in which the banknote handling apparatus 1 is installed is other than banks, a place in which the banknote handling apparatus 1 is installed is in a back office, rejected notes in dispensing may be stored in a storage unit having a relatively low security level in the banknote handling apparatus 1. This is because, in the facility, the security level in the back office is higher than the security level in the front office. The back office is an area into which only staff of the facility are allowed to go (that is, an area into which users of the facility are prohibited from going). For example, the back office is a management room of the facility or a space for office work in a bank or the like. Meanwhile, the front office represents an area into which not only staff of the facility but also users of the facility are allowed to go. For example, the front office represents a reception in a facility, or a space for sales activity in a bank or the like.

[Specific Example 3 of Operation Performed by Banknote Handling Apparatus]

Next, specific example 3 of an operation performed by the banknote handling apparatus 1 will be described with reference to FIG. 8 and FIG. 9. In this example, the specific kind corresponds to a rejected note in dispensing. In a case where a banknote for which determination is to be performed in dispensing is recognized by the recognition section 21, as being abnormal in transporting the control section 53 determines that the banknote for which determination is to be performed corresponds to a rejected note in dispensing. Destinations to which banknotes are transported include a first storage unit (the handling unit 61 in this example, specifically, the escrow unit 73), and a second storage unit (the safe unit 62 in this example, specifically, the collection cassette 86) having a security level higher than a security level of the first storage unit. In a case where a banknote recognized by the recognition section 21 corresponds to a rejected note in dispensing, the control section 53 determines whether the banknote is to be transported to the first storage unit or the second storage unit, according to the information about the use environment which has been set by the setting unit 52.

Specifically, in this example, the information about the use environment includes the shop information and the place information. The shop information indicates a business type of a shop in which the banknote handling apparatus 1 is installed, and the place information indicates an installation position (for example, front or back office), in the facility, at which the banknote handling apparatus 1 is installed. Further, the setting unit 52 has a transport control table as shown in FIG. 8. The transport control table (specific money transport rule) shown in FIG. 8 indicates whether the transport control method for a rejected note in dispensing (specific kind of banknote) is to be a first transport control method in which the banknote is transported to the first storage unit (in this example, the handling unit 61) or a second transport control method in which the banknote is transported to the second storage unit (in this example, the safe unit 62), is determined so as to correspond to the use environment of the banknote handling apparatus 1. The control section 53 determines one of the first transport control method or the second transport control method as the transport control method (specific money transport control method), for the rejected note in dispensing, corresponding to the information about the use environment which has been set by the setting unit 52, on the basis of the specific money transport rule which has been set by the setting unit 52. In a case where a banknote recognized by the recognition section 21 corresponds to a rejected note in dispensing, the control section 53 controls transporting of the banknote (rejected note in dispensing) by the transport unit 30 on the basis of the determined specific money transport control method.

Figures 8, 9:
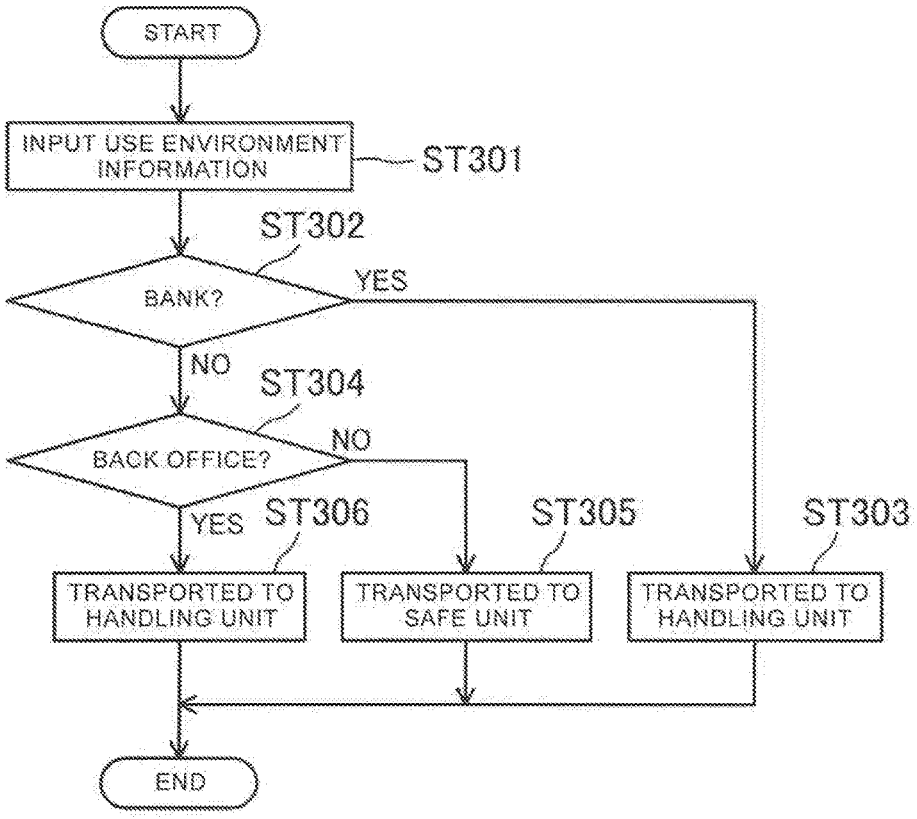
FIG. 8 illustrates a transport control table, according to specific example 3, which indicates correspondence between information about the use environment and specific money transport control methods.
FIG. 9 is a flow chart showing an operation, according to specific example 3, performed by the banknote handling apparatus.

In this example, the banknote handling apparatus 1 performs the setting operation shown in FIG. 9. The setting operation performed by the banknote handling apparatus 1 will be described with reference to FIG. 9.

<Step ST301>

The setting unit 52 sets the information about the use environment.

<Steps ST302, ST303>

Next, the control section 53 determines whether or not a business type indicated by the shop information of the information about the use environment corresponds to a bank (ST302). In a case where the business type indicated by the shop information of the information about the use environment corresponds to a bank, the control section 53 determines the first transport control method (transport control method in which a banknote is transported to the first storage unit (handling unit 61)) as the transport control method for a rejected note in dispensing (ST303). Meanwhile, in a case where the business type indicated by the shop information of the information about the use environment does not correspond to a bank, the process is advanced to step ST304.

[Steps ST304, ST305, ST306]

Next, the control section 53 determines whether or not the installation position (a position, in the facility, at which the banknote handling apparatus 1 is installed) indicated by the place information of the information about the use environment corresponds to a back office (ST304). In a case where the installation position indicated by the place information of the information about the use environment does not correspond to a back office, the control section 53 determines the second transport control method (transport control method in which a banknote is transported to the second storage unit (safe unit 62)) as the transport control method for a rejected note in dispensing (ST305). Meanwhile, in a case where the installation position indicated by the place information of the information about the use environment corresponds to a back office, the control section 53 determines the first transport control method (transport control method in which a banknote is transported to the first storage unit (handling unit 61)) as the transport control method for a rejected note in dispensing (ST306).

As described above, transporting of a rejected not in dispensing can be automatically controlled according to the use environment of the banknote handling apparatus 1.

[Modification of Banknote Handling Apparatus]

Figure 10:
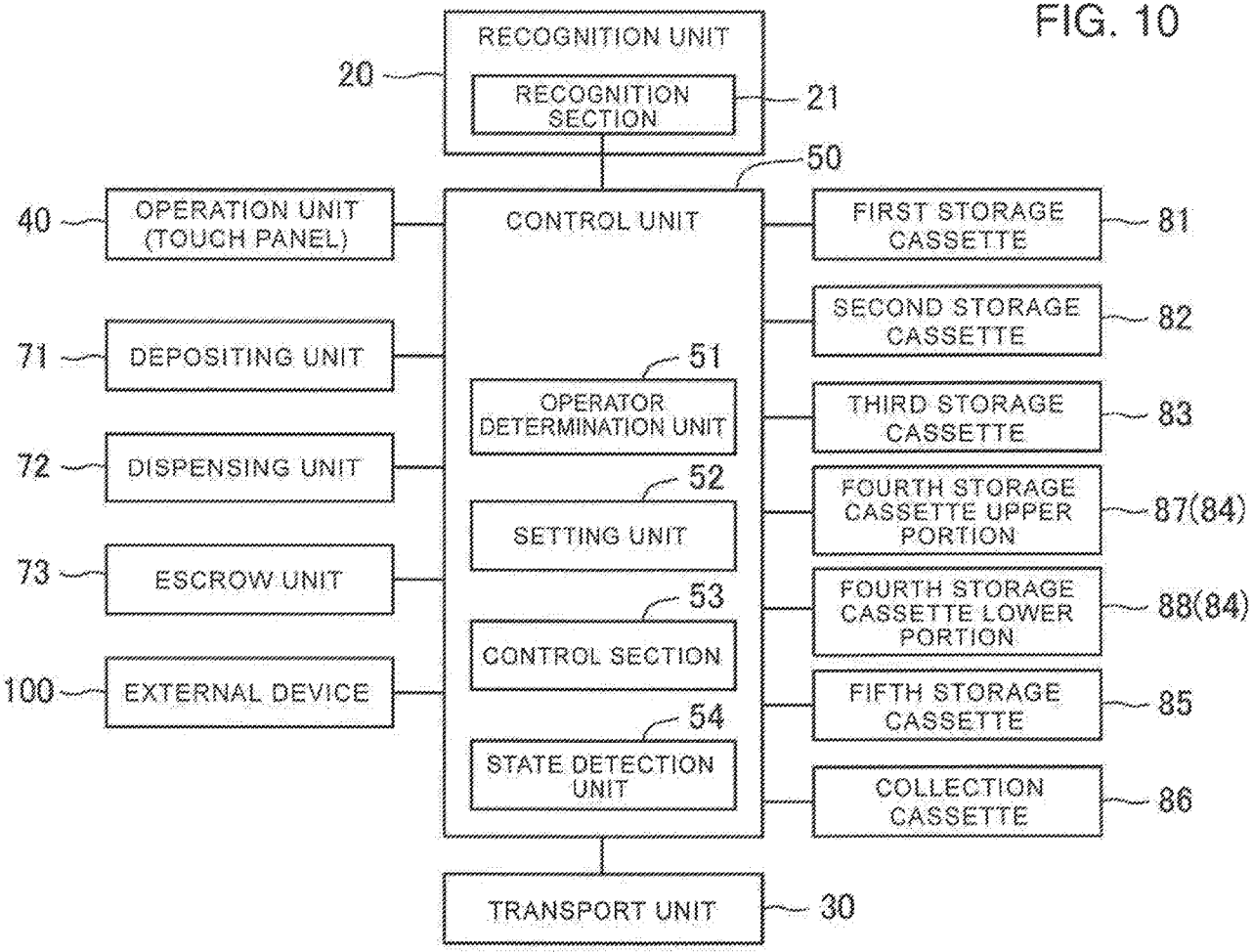
FIG. 10 is a block diagram illustrating a banknote handling apparatus according to modification 1 of the embodiment.

As shown in FIG. 10, the control unit 50 of the banknote handling apparatus 1 may include a state detection unit 54 in addition to the components shown in FIG. 3. The state detection unit 54 is configured to detect a use state in which the banknote handling apparatus 1 is used. In this example, the control section 53 controls transporting of banknotes according to the use state, of the banknote handling apparatus 1, detected by the state detection unit 54 and the information about the use environment which has been set by the setting unit 52.

In the above configuration, transporting of banknotes can be automatically controlled according to the use environment of the banknote handling apparatus 1 and the use state of the banknote handling apparatus 1.

Specifically, the setting unit 52 may be configured to set a specific state transport rule. In this example, the setting unit 52 may be configured to set (or change) the specific state transport rule according to an operation performed on the operation unit 40 (that is, information inputted to the operation unit 40). The specific state transport rule indicates a transport control method to be determined, as the transport control method (specific state transport control method) for a banknote in a specific use state that is predetermined in the banknote handling apparatus 1, so as to correspond to the use environment of the banknote handling apparatus 1. For example, the setting unit 52 may have a transport control table (see FIG. 11) that indicates the specific state transport rule. The transport control table indicates correspondence between the information about the use environment and the transport control method (specific state transport control method) for a banknote in a specific use state.

The control section 53 determines the transport control method (specific state transport control method), for a banknote in a specific use state, corresponding to the information about the use environment which has been set by the setting unit 52, on the basis of the specific state transport rule (transport control table) which has been set by the setting unit 52. In a case where a use state, of the banknote handling apparatus 1, detected by the state detection unit 54 corresponds to a specific use state, transporting of a banknote by the transport unit 30 may be controlled on the basis of the determined specific state transport control method.

Examples of the specific use state of the banknote handling apparatus 1 include an overflow state, a denomination-unset state, and a storage-cassette-unmounted state. An operation performed by the banknote handling apparatus 1 according to modifications will be specifically described below by using the states as examples.

<Specific Example 1 of Operation Performed by Banknote Handling Apparatus According to Modification>

Firstly, an exemplary case where an overflow state is the specific use state of the banknote handling apparatus 1, will be described. The overflow state represents a state in which the storage unit (specifically, the first to the fifth storage cassettes 81 to 85 and the collection cassette 86) provided in the banknote handling apparatus 1 for storing banknotes is full. The full state may be a state in which the storage unit is physically filled with banknotes, a state in which the weight of banknotes stored in the storage unit has reached a predetermined upper weight limit, a state in which the number of banknotes stored in the storage unit has reached a predetermined upper limit of banknotes, or a state in which the total monetary amount of banknotes stored in the storage unit has reached a predetermined upper limit. In this example, the state detection unit 54 is configured to detect a full state in which the storage unit is full. In a case where the state detection unit 54 detects a full state in which the storage unit is full, the control section 53 controls transporting of a kind of banknotes to be transported to the storage unit which is in the full state, according to the information about the use environment which has been set by the setting unit 52.

In the above configuration, in a case where the storage unit is in a full state, transporting of a kind of banknotes to be transported to the storage unit which is in the full state can be automatically controlled according to the use environment of the banknote handling apparatus 1.

<Specific Example 2 of Operation Performed by Banknote Handling Apparatus According to Modification>

Next, an exemplary case where a denomination-unset state is the specific use state of the banknote handling apparatus 1, will be described. The denomination-unset state represents a state in which a kind of a banknote recognized by the recognition section 21 is not assigned to any of the storage units (specifically, the first to the fifth storage cassettes 81 to 85 and the collection cassette 86) provided in the banknote handling apparatus 1 for storing banknotes. In this example, the state detection unit 54 is configured to detect that a kind of a banknote recognized by the recognition section 21 is not assigned to any of the storage units. In a case where the state detection unit 54 detects that a kind of a banknote recognized by the recognition section 21 is not assigned to any of the storage units, the control section 53 controls transporting of banknotes of the kind, according to the information about the use environment which has been set by the setting unit 52.

In the above configuration, in a case where a kind of a banknote recognized by the recognition section 21 is not assigned to any of the storage units, transporting of banknotes of the kind can be automatically controlled according to the use environment of the banknote handling apparatus 1.

<Specific Example 3 of Operation Performed by Banknote Handling Apparatus According to Modification>

Next, an exemplary case where a storage-cassette-unmounted state is the specific use state of the banknote handling apparatus 1, will be described. The storage-cassette-unmounted state represents a state in which a storage unit (specifically, the first to the fifth storage cassettes 81 to 85 and the collection cassette 86) that is detachably mounted to the banknote handling apparatus 1 and stores banknotes is detached from the banknote handling apparatus 1. In this example, the state detection unit 54 is configured to detect that the storage unit is detached from the banknote handling apparatus. In a case where the state detection unit 54 detects that the storage unit is detached from the banknote handling apparatus 1, the control section 53 controls transporting of banknotes to be transported to the storage unit that is detached, according to the information about the use environment which has been set by the setting unit 52.

In the above configuration, in a case where the storage unit is detached from the banknote handling apparatus 1, transporting of banknotes to be transported to the storage unit that is detached can be automatically controlled according to the use environment of the banknote handling apparatus 1.

[Specific Example 4 of Operation Performed by Banknote Handling Apparatus]

Next, specific example 4 of an operation performed by the banknote handling apparatus 1 will be described with reference to FIG. 12. In this example, the specific kind corresponds to a counterfeit note. Destinations to which banknotes are transported include a return unit (in this example, the dispensing unit 72) for returning banknotes to the outside of the banknote handling apparatus 1, and a reception unit (in this example, the collection cassette 86) for taking banknotes into the banknote handling apparatus 1. Further, the information about the use environment includes the user information representing a level of authority (an example of the role of a user) of the user of the banknote handling apparatus 1. In a case where a kind of a banknote recognized by the recognition section 21 corresponds to a counterfeit note, the control section 53 determines whether the banknote is to be transported to the return unit or the reception unit, according to the authority, or the user, indicated by the user information of the information about the use environment which has been set by the setting unit 52.

Figures 12, 13:
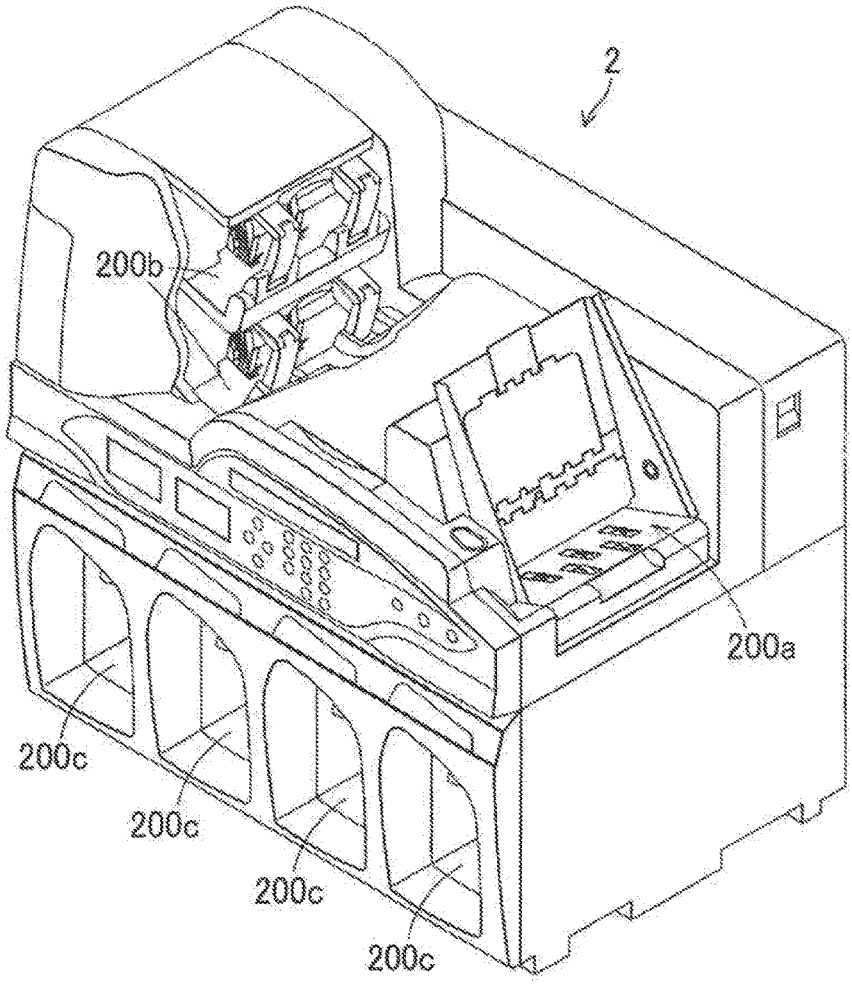
FIG. 12 illustrates a transport control table, according to specific example 4, which indicates correspondence between information about the use environment and specific money transport control methods.
FIG. 13 is a schematic perspective view of a banknote processing machine.

Specifically, in this example, the setting unit 52 has a transport control table as shown in FIG. 12. The transport control table (specific money transport rule) shown in FIG. 12 indicates whether the transport control method for a counterfeit note (specific kind of banknote), is to be a first transport control method in which the banknote is transported to the return unit or a second transport control method in which the banknote is transported to the reception unit, and is also determined so as to correspond to the level (level of the authority of the user) of a user of the banknote handling apparatus 1. The control section 53 determines one of the first transport control method or the second transport control method, as the transport control method (specific money transport control method), for the counterfeit note, corresponding to the information about the use environment which has been set by the setting unit 52, on the basis of the specific money transport rule which has been set by the setting unit 52. In a case where a kind of a banknote recognized by the recognition section 21 corresponds to a counterfeit note, the control section 53 controls transporting of the banknote (counterfeit note) by the transport unit 30 on the basis of the determined specific money transport control method.

In the above configuration, transporting of a counterfeit note can be automatically controlled according to the authority of the user of the banknote handling apparatus 1.

The control section 53 may be configured to stop transporting a banknote according to the authority, of the user, indicated by the user information of the information about the use environment which has been set by the setting unit 52, in a case where a kind of the banknote recognized by the recognition section 21 corresponds to a counterfeit note.

(Other Embodiments)

FIG. 13 illustrates a banknote processing machine 2 as an example of the banknote handling apparatus 1. The banknote processing machine 2 is configured to sort and count a plurality of banknotes having been inserted, according to predetermined contents for sorting. The banknote processing machine 2 includes: a hopper 200*a* for taking in banknotes; two reject units 200*b* for discharging rejected notes; and four stacking units 200*c* each of which stacks banknotes. The banknote processing machine 2 includes thereinside the recognition unit 20, the transport unit 30, and the control unit 50. Also in the banknote processing machine 2, the setting unit 52 is configured to set information about the use environment concerning a use environment in which the banknote processing machine 2 is used, the transport unit 30 is configured to transport banknotes, the recognition section 21 is configured to recognize a kind of a banknote, and the control section 53 is configured to control transporting of banknotes by the transport unit 30 according to recognition result for a banknote by the recognition section 21. The control (including control according to specific examples 1, 2, and 3, and the like) by the banknote handling apparatus 1 described above, and control (including control according to specific examples 1, 2, and 3, and the like) by the banknote handling apparatus 1 according to modifications described above are applicable also to the banknote processing machine 2 shown in FIG. 13.

In the banknote handling apparatus 1, another function (function different from control of the transport unit 30) of the banknote handling apparatus 1 may be automatically set according to the information about the use environment in the setting unit 52. For example, in the banknote handling apparatus 1, in a case where the recognition section 21 recognizes a kind of a banknote as corresponding to a counterfeit note, whether or not warning is issued by a warning unit or whether or not information of the banknote recognized as corresponding to a counterfeit note is stored in an output data file, may be automatically determined according to the information about the use environment in the setting unit 52.

Further, an exemplary case where the dispensing unit 72 performs dispensing of banknotes is described above. However, the dispensing unit 72 may be configured as a depositing and dispensing unit that performs depositing and dispensing of banknotes, or a rejected note discharge unit that discharges rejected notes.

The first to the fifth storage cassettes 81 to 85 (money storage unit) may be configured as recyling storage units for recyling banknotes, or depositing storage units for performing only depositing of banknotes.

The collection cassette 86 (collection unit) may be configured to store only banknotes to be collected, or may be configured to store not only banknotes to be collected but also the other banknotes.

The escrow unit 73 may be configured as a tape-reeling type unit, or may be configured as a cassette-type stacking unit.

Further, the control section 53 may be configured to determine, in a case where a banknote for which determination is to be performed, is recognized, by the recognition section 21, as a banknote of an undesignated denomination (that is, a denomination designated as a denomination to be handled by the banknote handling apparatus 1), that the banknote for which determination is to be performed corresponds to a rejected note in dispensing. That is, the control section 53 may be configured to determine, in dispensing, that at least one of a banknote recognized as being abnormal in transporting, and a banknote of an undesignated denomination, corresponds to a rejected note in dispensing.

Further, the recognition section 21 may be configured to recognize a category (category defined by the European Central Bank, for example denomination) of a banknote in recognition of a denomination of a banknote.

Further, the reception unit described above may be any one of the dispensing unit 72, the escrow unit 73, the first to the fifth storage cassettes 81 to 85, and the collection cassette 86 as shown in FIG. 2, the reject unit 200*b* and the stacking unit 200*c* as shown in FIG. 13, and other units that receive banknotes.

An exemplary case where the setting unit 52 sets (or changes) the specific money transport rule according to an operation performed on the operation unit 40, is described. However, the setting unit 52 may be configured so as not to allow the specific money transport rule to be changed. That is, the specific money transport rule may be a rule which is optionally set (or changed) by an operator of the banknote handling apparatus 1 after delivery from a factory, or may be a rule which is previously registered by a manufacturer of the banknote handling apparatus 1 before delivery from a factory (a rule which cannot be optionally changed by an operator of the banknote handling apparatus 1 after delivery from the factory).

Further, an exemplary case where an operator to be identified by the operator determination unit 51 is an "operator who operates the operation unit 40 provided in the banknote handling apparatus 1", is described. However, an operator to be identified by the operator determination unit 51 may be an "operator who remotely controls the banknote handling apparatus 1 by using the external device 100". That is, the operator determination unit 51 may be configured to determine whether or not an operator (an example of an operator of the banknote handling apparatus 1) who remotely controls the banknote handling apparatus 1 corresponds to a predetermined specific operator. For example, the operator determination unit 51 may compare an identification (ID), of an operator of the external device 100, which is read in the external device 100, with a previously stored identification (ID) (identification (ID) assigned to the specific operator), and determine whether or not the operator corresponds to the specific operator.

Further, the techniques disclosed herein are applicable to coin handling apparatuses (an example of the money handling apparatus) which handle coins, as well as banknote handling apparatuses (an example of the money handling apparatus) which handle banknotes.

Further, the above-described embodiments may be implemented in combination as appropriate. The above-described embodiments are essentially preferred exemplary embodiments, and are not intended to restrict scopes of the disclosure thereof, the application thereof, or the usage thereof.

As described above, the techniques disclosed herein are useful as a money handling apparatus that handles money, and a money handling method for handling money by using the money handling apparatus.

What is claimed is:

1. A money handling apparatus that handles money, the money handling apparatus comprising:

a setting unit that sets information about a use environment in which the money handling apparatus is used;

a transport unit that transports the money;

a recognition unit that recognizes a kind of the money; and a control unit that controls transporting of the money by the transport unit, according to a recognition result for the money by the recognition unit, wherein the control unit controls transporting of the money according to the information about the use environment when it is set by the setting unit, in a case where the kind of the money recognized by the recognition unit corresponds to a predetermined specific kind, the information about the use environment includes at least one of place information concerning a position, in a facility, at which the money handling apparatus is installed and shop information concerning a shop in which the money handling apparatus is installed.

2. The money handling apparatus according to claim 1, wherein the shop information represents a business type of the shop in which the money handling apparatus is installed.

3. The money handling apparatus according to claim 1, wherein the control unit stops transporting the money according to the information about the use environment which is set by the setting unit, in a case where the kind of the money recognized by the recognition unit corresponds to the specific kind.

4. The money handling apparatus according to claim 1, further comprising an operator determination unit that determines whether or not an operator of the money handling apparatus is a predetermined specific operator, wherein the setting unit allows, in a case where the operator determination unit determines that the operator is the specific operator, the information about the use environment to be set according to an operation performed by the operator.

5. The money handling apparatus according to claim 1, wherein the control unit transports the money to a predetermined destination according to the information about the use environment which is set by the setting unit, in a case where the kind of the money recognized by the recognition unit corresponds to the specific kind.

6. The money handling apparatus according to claim 5, wherein

The predetermined destination includes a return unit for returning the money to an outside of the money handling apparatus, and a reception unit for taking the money into the money handling apparatus, the specific kind corresponds to counterfeit money, the control unit determines, in a case where the kind of the money recognized by the recognition unit corresponds to the counterfeit money, whether the money is transported to the return unit or the reception unit, according to the information about the use environment.

7. The money handling apparatus according to claim 5, wherein the specific kind corresponds to unfit money, and the control unit determines, in a case where the kind of the money recognized by the recognition unit corresponds to the unfit money, whether the money is handled as unfit money or fit money, according to the information about the use environment.

8. The money handling apparatus according to claim 5, wherein

The predetermined destination includes a first storage unit, and a second storage unit having a security level higher than a security level of the first storage unit, the specific kind corresponds to rejected money in dispensing, and the control unit determines, in a case where the money recognized by the recognition unit corresponds to the rejected money in dispensing, whether the money is transported to the first storage unit or the second storage unit, according to the information about the use environment.

9. The money handling apparatus according to claim 1, further comprising a state detection unit that detects a use state in which the money handling apparatus is used, wherein the control unit controls transporting of the money according to the use state and the information about the use environment.

10. The money handling apparatus according to claim 9, further comprising a storage unit that stores the money, wherein the control unit controls, in a case where the state detection unit detects that the storage unit is full, transporting of a kind of the money to be transported to the storage unit which is full, according to the information about the use environment.

11. The money handling apparatus according to claim 9, further comprising a storage unit that stores the money, wherein the control unit controls, in a case where the state detection unit detects that the kind of the money recognized by the recognition unit is not assigned to the storage unit, transporting of the kind of the money, according to the information about the use environment.

12. The money handling apparatus according to claim 9, further comprising a storage unit that is detachably mounted to the money handling apparatus and that stores the money, wherein the control unit controls, in a case where the state detection unit detects that the storage unit is detached from the money handling apparatus, transporting of the money to be transported to the storage unit which is detached, according to the information about the use environment.

13. A money handling method in which a money handling apparatus handles money, the money handling method comprising:

a setting step of setting, by a setting unit, information about a use environment in which the money handling apparatus is used;

a recognition step of recognizing a kind of the money by a recognition unit; and a transport control step of controlling, by a transportation unit and a control unit, transporting of the money corresponding to a predetermined specific kind among kinds of the money, according to the information about the use environment when it is set in the setting step, wherein the information about the use environment includes at least one of place information concerning a position, in a facility, at which the money handling apparatus is installed and shop information concerning a shop in which the money handling apparatus is installed.

* * * * *